US008218801B2

(12) United States Patent
Duron et al.

(10) Patent No.: US 8,218,801 B2
(45) Date of Patent: Jul. 10, 2012

(54) METHOD AND SYSTEM FOR A HEADSET H-FIELD/E-FIELD CANCELLER

(75) Inventors: Mark Duron, East Patchogue, NY (US); Richard Knadle, Dix Hills, NY (US)

(73) Assignee: Symbol Technologies, Inc., Holtsville, NY (US)

( * ) Notice: Subject to any disclaimer, the term of this patent is extended or adjusted under 35 U.S.C. 154(b) by 1076 days.

(21) Appl. No.: 12/130,361

(22) Filed: May 30, 2008

(65) Prior Publication Data

US 2009/0296947 A1 Dec. 3, 2009

(51) Int. Cl.
*H04R 25/00* (2006.01)

(52) U.S. Cl. ..... 381/317; 381/322

(58) Field of Classification Search ..... 381/71.3, 381/71.6, 71.7, 71.8, 94.6, 317, 318, 312, 381/322, 326, 331

See application file for complete search history.

(56) References Cited

U.S. PATENT DOCUMENTS

| | | | | |
|---|---|---|---|---|
| 5,086,464 | A * | 2/1992 | Groppe | 381/331 |
| 5,729,222 | A * | 3/1998 | Iggulden et al. | 341/31 |
| 5,812,673 | A * | 9/1998 | Nohara et al. | 381/13 |
| 6,078,675 | A * | 6/2000 | Bowen-Nielsen et al. | 381/331 |
| 6,694,034 | B2 * | 2/2004 | Julstrom et al. | 381/315 |
| 6,714,654 | B2 * | 3/2004 | Lichtblau | 381/317 |
| 6,879,693 | B2 * | 4/2005 | Miller et al. | 381/60 |
| 6,925,179 | B2 * | 8/2005 | Waldron et al. | 379/443 |
| 7,787,648 | B1 * | 8/2010 | Frerking et al. | 381/317 |
| 7,978,867 | B2 * | 7/2011 | Waldron et al. | 381/312 |
| 2003/0161482 | A1 * | 8/2003 | Miller et al. | 381/60 |
| 2003/0163021 | A1 * | 8/2003 | Miller et al. | 600/25 |
| 2003/0163022 | A1 * | 8/2003 | Miller et al. | 600/25 |
| 2004/0234094 | A1 * | 11/2004 | Saunders et al. | 381/380 |
| 2004/0247145 | A1 * | 12/2004 | Luo et al. | 381/312 |
| 2006/0126873 | A1 * | 6/2006 | Lee | 381/312 |
| 2006/0188116 | A1 * | 8/2006 | Frerking et al. | 381/315 |
| 2006/0269076 | A1 * | 11/2006 | Miller et al. | 381/60 |
| 2007/0127744 | A1 * | 6/2007 | van Halteren et al. | 381/150 |
| 2007/0285284 | A1 * | 12/2007 | Matteo et al. | 341/22 |
| 2008/0079645 | A1 * | 4/2008 | Higasa et al. | 343/770 |
| 2008/0251364 | A1 * | 10/2008 | Takala et al. | 200/341 |
| 2009/0002199 | A1 * | 1/2009 | Lainonen et al. | 341/20 |
| 2009/0008234 | A1 * | 1/2009 | Tolbert et al. | 200/600 |
| 2009/0201652 | A1 * | 8/2009 | Chew et al. | 361/749 |
| 2009/0220114 | A1 * | 9/2009 | Wilson | 381/317 |
| 2009/0296947 | A1 * | 12/2009 | Duron et al. | 381/71.6 |
| 2010/0054513 | A1 * | 3/2010 | Bally et al. | 381/322 |
| 2010/0195857 | A1 * | 8/2010 | Gebhardt et al. | 381/317 |
| 2010/0220867 | A1 * | 9/2010 | Frerking et al. | 381/71.6 |
| 2011/0019849 | A1 * | 1/2011 | Nielsen | 381/322 |

* cited by examiner

*Primary Examiner* — David S. Warren

(57) ABSTRACT

Described are a device and a method for canceling a magnetic field and/or an electric field emitted from a device. The device includes a housing including an inner wall and an outer wall, a sense coil located within the inner wall of the housing in proximity to a user's ear, the sense coil sensing a magnitude, polarization and a polarity of an inbound magnetic field within the housing, and an induction coil located between the outer wall and the inner wall of the housing, the induction coil generating an outbound magnetic field having the same polarization and an opposing polarity to the polarity of the inbound magnetic field. The method includes sensing, by a sensing coil, a magnitude and a polarity of an inbound magnetic field, the sensing coil located within a housing of a device, and applying a current to an induction coil to generate an outbound magnetic field having an opposing polarity to the polarity of the inbound magnetic field, the induction coil located within the housing of the device.

13 Claims, 5 Drawing Sheets

METHOD AND SYSTEM FOR A HEADSET H-FIELD/E-FIELD CANCELLER

FIELD OF INVENTION

The present application generally relates to systems and methods for canceling a magnetic field and/or an electric field emitted from a device. Specifically, the systems and methods may create a null within a magnetic shield and/or an electric shield in order to allow for electronic devices held near a user's ear to be compliant with hearing-aid compatibility requirements.

BACKGROUND

As the use of wireless electrical devices become more prevalent in both business and personal environments, the guidelines and restrictions related to the usage of these devices are continuously examined by regulatory bodies, such as the Federal Communication Commission ("FCC"). These regulatory bodies have taken measures to ensure that people with hearing impairments may have access to communication networks through digital wireless telephones. Thus, the FCC enacted the Hearing Aid Compatibility Act of 1988 (HAC Act) to ensure that all telephones manufactured or imported for use in the United States, and all "essential telephones" are hearing aid-compatible. The collection of "essential telephones" had been defined to include coin-operated telephones, telephones provided for emergency use, and any other telephones frequently needed for use by a hearing impaired person, such as telephones in the workplace, in hospitals and nursing homes, and in hotel rooms. Initially, wireless telephones were exempt.

While analog wireless telephones do not usually cause interference with hearing aid devices, digital wireless telephones may cause interference due to the electromagnetic energy emitted from the telephone's antenna, backlight, battery, and/or other components. In 2001, the FCC established a measurement standard for categorizing both hearing aid device and wireless devices in order to provide hearing-impaired individuals with access to wireless communication networks. The wireless devices were tested for radio frequency ("RF") emissions as well as other emissions (e.g., magnetic field ("H-field") emissions, electric field ("E-field") emissions), while the hear aid devices were tested for susceptibility to such emissions. Both the wireless devices and the hearing aid devices were assigned categories based on a combined performance rating in order to establish which hearing aids are compatible with which wireless device.

In 2003, the FCC removed the exemption for wireless telephones from the original HAC Act. A timetable for compliance was established, wherein wireless service providers were required to offer customers access to predefined percentages of headsets that met certain RF, E-field, and H-field emission requirements. The predefined percentages have been gradually increased, such that by Feb. 2008, the service providers must ensure that 50% of their wireless headsets meet the emission requirements. Accordingly, the new HAC Act requirements can make compliance very expensive and difficult, if not impossible, with any electronic devices used near an individual's ears.

In the prior art, the field cancellation is made in the far field using a planar field model. However, due to the relative proximity of the transmitter and probes to an earpiece and the user's head (i.e., within less than ¼ wavelength), significant field distortion occurs in these areas. Furthermore, in this environment, a simple planar model of field strength is highly inaccurate.

SUMMARY OF THE INVENTION

The present application relates to a device for canceling a magnetic field and/or an electric field emitted from a device. The device includes a housing including an inner wall and an outer wall, a sense coil located within the inner wall of the housing in proximity to a user's ear, the sense coil sensing a magnitude, polarization and a polarity of an inbound magnetic field within the housing, and an induction coil located between the outer wall and the inner wall of the housing, the induction coil generating an outbound magnetic field having the same polarization and an opposing polarity to the polarity of the inbound magnetic field.

The present application furthers relates to a method for canceling a magnetic field and/or an electric field emitted from a device. The method includes sensing, by a sensing coil, a magnitude, polarization and a polarity of an inbound magnetic field, the sensing coil located within a housing of a device, and applying a current to an induction coil to generate an outbound magnetic field having an opposing polarity to the polarity of the inbound magnetic field, the induction coil located within the housing of the device The present application furthers relates to an electronic device for canceling a magnetic field and/or an electric field emitted from a device. The electronic device includes a sensing means for sensing a magnitude, polarization and a polarity of an inbound magnetic field, the sensing means located within a housing of a device, and a field generating means for generating an outbound magnetic field having an opposing polarity to the polarity of the inbound magnetic field, the field generating means located within the housing of the device.

DETAILED DESCRIPTION

Figure 1:
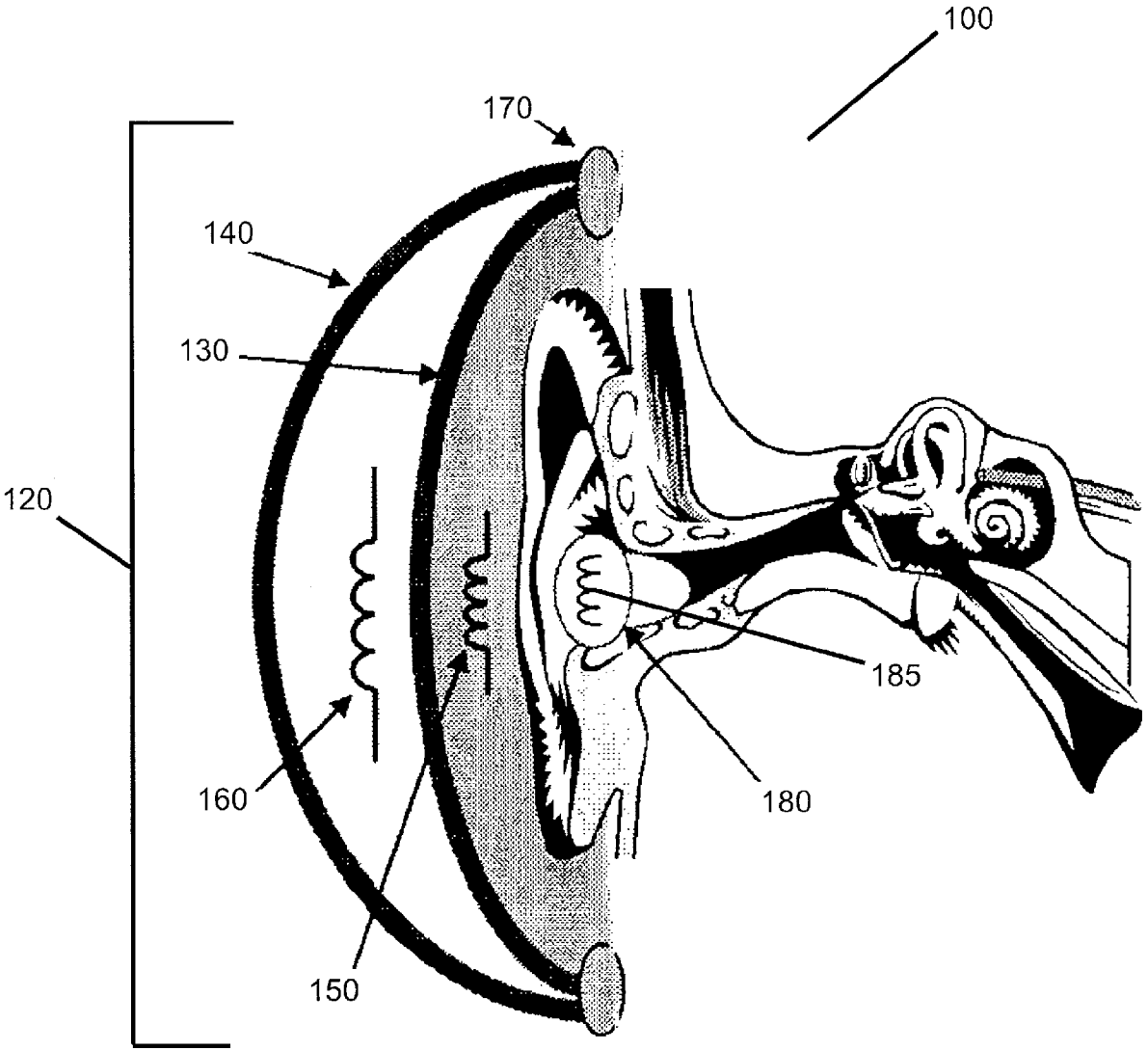
FIG. 1 shows an exemplary system for shielding magnetic field emissions and/or electric field emissions from a mobile unit according to exemplary embodiments of the present invention.

The present invention may be further understood with reference to the following description of exemplary embodiments and the related appended drawings, wherein like elements are provided with the same reference numerals. The exemplary embodiments of the present invention are related to systems and methods used for canceling a magnetic field ("H-field") and/or an electric field ("E-field") emitted from a device. Specifically, the system and methods may create a magnetic shield and/or an electric shield in order to allow for electronic devices held near a user's ear to be compliant with hearing-aid compatibility requirements. It should be noted that while the term "shield" may be used throughout the description of the exemplary embodiments, the present invention may incorporate any type of mechanical supports for reduction or canceling, or otherwise counteracting, magnetic and electric emissions. Accordingly, the exemplary embodiments of the present invention allow for accurate measurements of H-fields and/or E-fields, as well as the cancellation and reduction of these measured fields.

Those skilled in the art will understand that the exemplary embodiments of the present invention are described with reference to a wireless communication device, such as digital mobile telephone or a digital wireless headset, but that the present invention may also be implemented in conjunction with other types of electronic devices. That is, the exemplary embodiments of the present invention may also be applied to reduce the magnetic and/or electric field emissions from any components of other electronic devices.

A telephone that is hearing aid compatible may have an internal feature that allows for the use of specially designed hearing aids. According to recent FCC regulations, any telephone that is subject to the HAC Act is required to provide an adequate range of volume and to produce a magnetic field of sufficient strength and quality to permit coupling with a hearing aid device that contains a telecoil, or "T-coil". The telecoil may be defined as a magnetic induction coil on a hearing aid device that, when activated, may pick up a voice signal from an electromagnetic field transmitted from a compatible telephone. Specifically, the telecoil may allow for different sounds to be connected directly to the hearing aid device, thereby improving sound quality of the intended signal while reducing the effects of any background noise. The telecoil may be compatible with device such as telephones, radio receivers, public address systems, etc. The telecoil may be comprised of an ultra-thin wire coiled around a metallic rod. In operation, the telecoil may detect electromagnetic ("EM") energy, convert the EM energy into electrical signals, and transmit the signals to the hearing aid device (or other device for amplification).

It should be noted that the telecoil may also pick up magnetic energy similar to a microphone picking up an acoustic signal. Due to the sensitivity to EM energy and magnetic energy, the telecoil may experience various degrees of interference (e.g., background noise) based on the proximity of the telecoil to certain types of electrical devices, such as mobile communication devices. Furthermore, it should also be noted that while the exemplary embodiments described herein incorporate a telecoil within the hearing aid device, the systems and methods of the present invention may also be implemented within hearing devices lacking a telecoil. In other words, the scope of the present invention is not limited to any specific type of hearing aid device. Accordingly, the exemplary embodiments of the present invention allow for canceling, or otherwise counteracting, magnetic and electric emissions within the hearing aid device regardless of the presence of a telecoil or inductive pick-up.

While prior art field cancellation is made in the far field using a planar field model, the exemplary embodiments of the present invention allow for the electromagnetic radiation cancellation to take place in the near field. Specifically, both the H-fields and the E-fields are cancelled separately. Furthermore, as will be described in greater detail below, each field component of either or both of the H-field or E-fields may be cancelled in up to three orthogonal axes at a given time.

FIG. 1 shows an exemplary system 100 including a headset 120 for shielding, or canceling, magnetic field emissions and/or electric field emissions from a mobile unit ("MU") (not shown) according to exemplary embodiments of the present invention. Those skilled in the art will understand that while the headset 120 is an exemplary embodiment of the present invention, other types of coverings may also be used in proximity to a user in order to shield a hearing aid device 180 worn by the user. As described above, the hearing aid device 180 may include a telecoil 185. According to the exemplary embodiments of the present invention, the telecoil 185 may be able to pick up inductive fields in order to operate.

The headset 120 may be a wearable arrangement covering a user's ear, or ears, and may include a housing (e.g., an inner wall 130 and an outer wall 140), a sense element 150, an induction coil (or "bucking coil") 160, and padding 170. The padding 170 may allow for the headset 120 to rest comfortably on or around the user's ear, or ears. Accord to the exemplary embodiments of the present invention, the headset 120 may reduce or eliminate the radiated magnetic emissions and/or radiated electric emissions from the MU, thereby allowing the MU to achieve hearing aid compatibility. While the exemplary embodiments of the present invention describe the headset 120 as shielding magnetic and/or electric field emissions from the MU, it should be noted that the exemplary embodiments of the present invention may be applicable to shield, or cancel, any type of electronic equipment from the hearing aid device 180.

According to the exemplary embodiment of the headset 120, the sense element 150 may be positioned between the inner wall 130 and the user (e.g., the ear of the user). As such, the sense element 150 may be in close proximity to the hearing aid device 180, adjacent to the telecoil 185. The sense element 150 may include wiring and circuitry for sensing magnetic and/or electric fields. Therefore, as a voltage is generated across the sense element 150, the system 100 may sense the magnitude, polarization and polarity of any present H-field and/or E-field.

The exemplary induction coil 160 of the headset 120 may be positioned between the inner wall 130 and the outer wall 140. Based on the magnitude and polarity sensed at the sense element 150, an electric current may be applied to the induction coil 160 to phase out, or cancel out, any H-field emissions that may penetrate the inner wall 130 of the headset 120. Specifically, the electric current applied to the induction coil 160 may generate a magnetic field of equal magnitude and an opposite polarity of the magnetic field detected by the sense element 150 within the headset 120. Thus, the induction coil 160 may discharge a destructive H-field emission intended to diminish or completely cancel out any magnetic emissions from the MU in any or all of three orthogonal axes.

In addition, as described above, the system 100 may also diminish or completely cancel out any electric field emissions from the MU. For example, the headset 120 may further include electrostatic probes (not shown). These electrostatic probes may be use in conjunction with, or alternatively, as a substitute to, the induction coil 160. Specifically, the sense element 150 may detect any penetrating E-field emissions from the MU, or from other sources. Accordingly, similar to the induction coil 160, the E-field emissions from the electrostatic probes may be adjusted to counteract the inbound E-field emissions. Therefore, the electrostatic probes may diminish or completely cancel out these electric emissions in any or all of three orthogonal axes. Thus, the headset 120 may be implemented to cancel both H-field emissions and E-field emissions through the simultaneous use of the induction coil 160 and the electrostatic probes.

Furthermore, according to the exemplary embodiments of the present invention, both the inner wall 130 and the outer wall 140 may be formed of metal and may cover the ears of a user. Therefore, the walls may create a partial magnetic shield from the H-field emissions of the MU. Any remaining H-field emissions that penetrate through both the inner wall 130 and the outer wall 140 may be detected by the telecoil 185 of the hearing aid device 180 as well as the sense element 150 of the headset 120. It should be noted that if the walls are partial shields, then the induction coil 160 may be used as a pickup for the T-coil field and the signal may be relayed to the telecoil 185 by the sense element 150.

According to one exemplary embodiment of the system 100, the MU may also act as an audio pickup. Specifically, the MU may convert the audio energy external to the headset to an alternating current, wherein this current may then be applied to the induction coil 160 as a relay device to the telecoil 185 of the hearing aid device 180. According to a further exemplary embodiment of the system 100, the headset 120 may also act as an audio pickup. Specifically, the headset 120 may convert the audio energy external to the headset 120 to an alternating current, wherein this current may be applied to the induction coil 160 as a relay device to the telecoil 185 of the hearing aid device 180.

It should be noted that the headset 120, according to additional embodiments of the present invention, may further include an external pick-up coil (not shown). The pick-up coil may be used to pick up intended magnetic emissions and relay these emissions through the system 100. Specifically the pick-up coil may convert magnetic field charges into electrical impulses. An integrator (not shown) with the system 100 may reconstruct these electrical impulses into a form that defines the intended H-field.

Figure 2A:
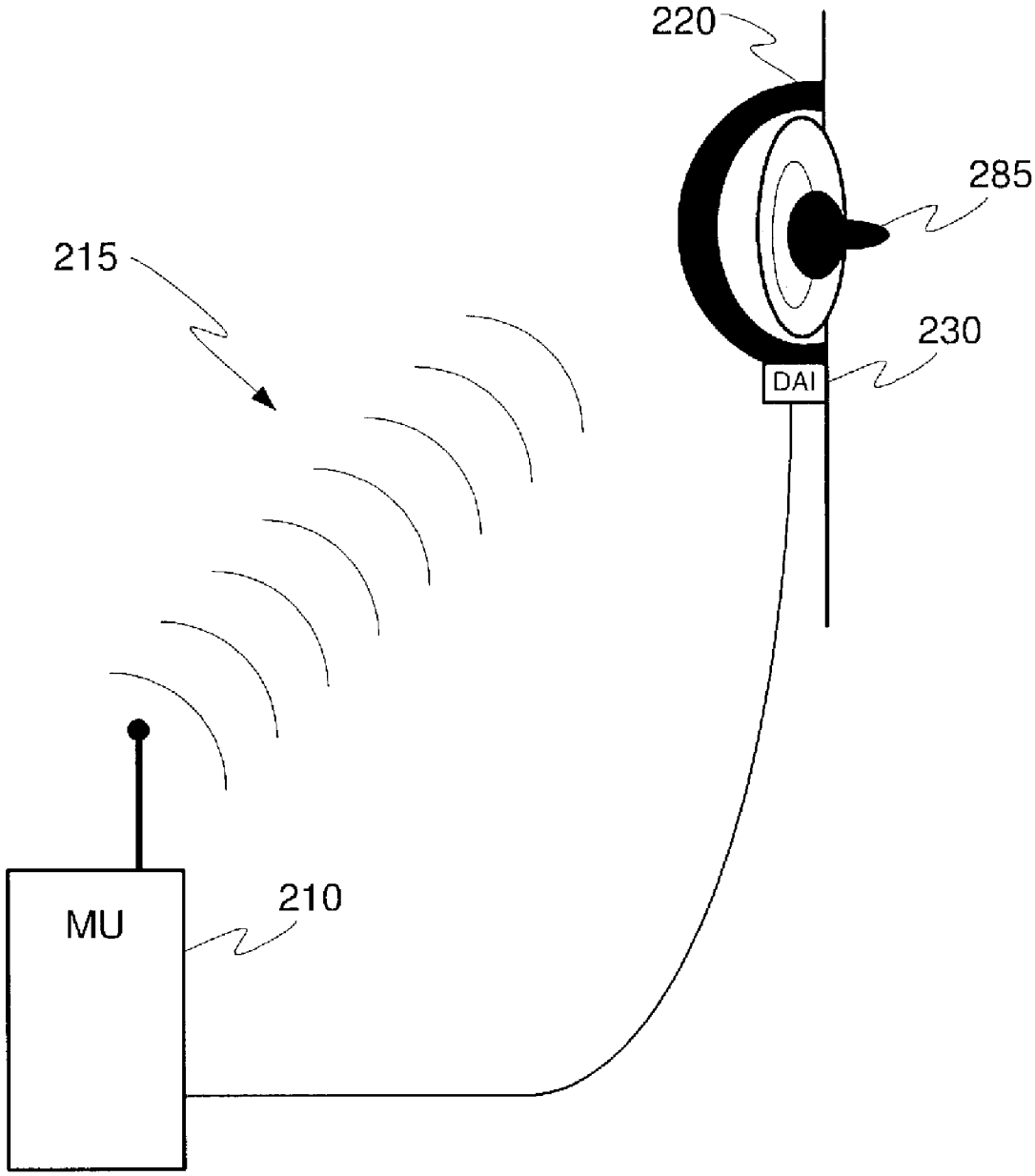
FIG. 2*a-b* show exemplary headsets in relation to a mobile unit, wherein magnetic emissions from mobile unit are diminished or completely canceled out prior to reaching a telecoil according to the exemplary embodiments of the present invention.

FIG. 2*a* shows an exemplary headset 220 in relation to an MU 210, wherein electromagnetic emissions 215 from electronic devices are diminished or completely canceled out prior to reaching a telecoil 285 of a user according to the exemplary embodiments of the present invention. According to the exemplary embodiments of the present invention, the headset 220 may be used in conjunction with an electronic device, such as MU 210. Specifically, the headset 220 may be a wired or wireless hands-free headset. Furthermore, the headset 220 may utilize localized wireless communication between the headset 220 and the MU 210, such as a personal area network ("PAN") (e.g., Bluetooth, ZigBee, etc.). Accordingly, the headset 220 may be capable of transmitting telephonic communication to the telecoil 285 while shielding the telecoil 285 from any interfering electromagnetic emissions 215 from the MU 210.

The exemplary MU 210 may be a mobile cellular telephone, a PDA, a wireless-enabled laptop, any portable electronic device that emits electromagnetic radiation, etc. While the guidelines and regulations implemented under the HAC Act may limit the use of electronic equipment in proximity to the telecoil 285 of a hearing aid device, the exemplary headset 220 may allow electronic devices such as MU 210 to comply with these guidelines and regulations As described above, electromagnetic shielding may be described as the process of limiting the flow of electromagnetic fields between two locations, specifically, by separating the two locations with a barrier made of conductive material. Accordingly, electromagnetic shielding may be used to block radio frequency electromagnetic radiation emitted from electrical devices. Thus, the shielding may reduce or eliminate electromagnetic fields (e.g., H-field/E-field), wherein the amount of reduction depends upon the material used, the thickness of the material, and the frequencies of the fields of interest.

According to the exemplary embodiments of the present invention, the headset 220 may limit the flow of electromagnetic fields between MU 210 and the telecoil 285 in order to prevent the emissions 215 from interfering with the operation of the telecoil 285. Specifically, the headset 220 may be constructed from materials used for electromagnetic shielding, such as sheet metal, metal mesh, and metal foam. As described with reference to FIG. 1, this material may serve as the inner wall 130, the outer wall 140, or both. It should be noted that any holes in the material (e.g., metal mesh) may be significantly smaller than the wavelength of the emissions 215 in order to effectively diminish or cancel out any interference from the emissions 215.

In addition, another commonly used shielding method may be a plastic enclosure, wherein the inside of the plastic enclosure is coated with a metallic paint, ink or similar material. The paint may consist of a carrier material loaded with a suitable metal, such as copper or nickel, in the form of very small particulates, Specifically, the inner and/or outer walls, 130 and 140, may be manufactured from plastic. The metallic paint may be sprayed on to the walls 130 and 140 in order to provide a continuous conductive layer of metal. Furthermore, this conductive layer of metal may be electrically connected to a ground of the headset 220, thus providing effective shielding of the emissions 215 from the telecoil 285.

According to an additional embodiment of the present invention, the headset 220 may further include a direct audio input ("DAI") port 230. The DAI port 230 may allow the headset 220 to connect to an external audio source, such as the MU 220, via a DAI cable. Specifically, the input signal from the DAI port 230 may be processed using the same circuits and programs that are used by the telecoil 285. Alternatively, the DAI port 230 may use a separate circuit and programs for processing the signal. Furthermore, the MU 220 may be an assistive listening device connectable to the DAI port 230. Therefore, while the headset 220 shields the telecoil 285 from any electromagnetic interference from the MU 220, the DAI port 230 may allow for the intended audio signals to be received by the headset 220 and communicated to the user.

Figure 2B:
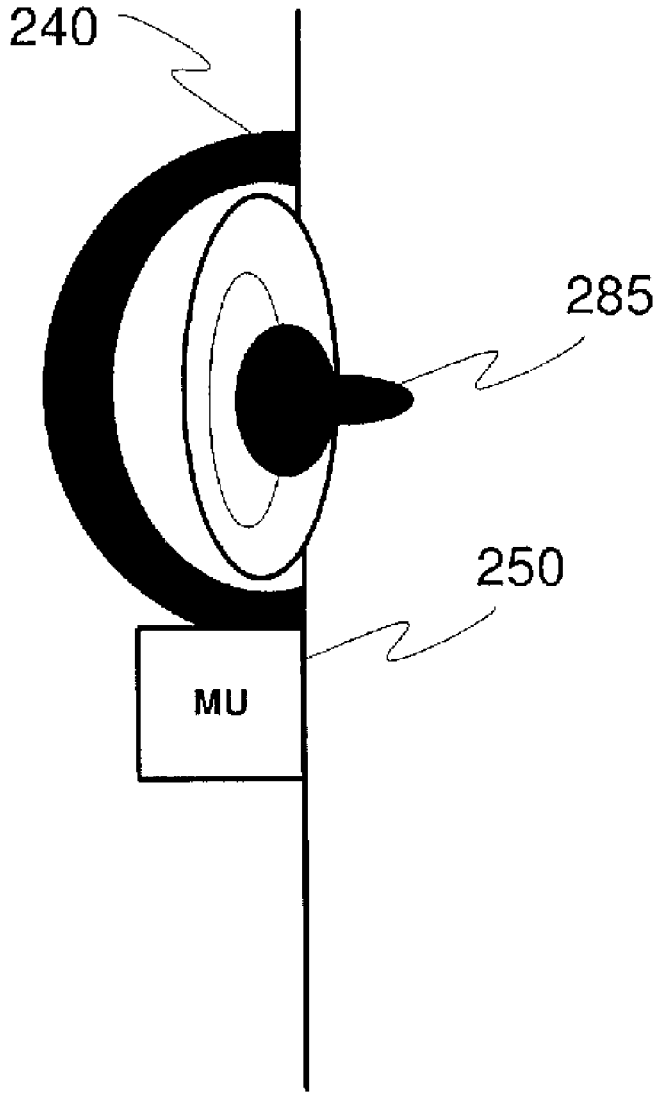

FIG. 2*b* shows an exemplary headset 240 in relation to an MU 250, wherein electromagnetic emissions are diminished or completely canceled out prior to reaching a telecoil 285 of a user according to the exemplary embodiments of the present invention. According to this embodiment, the MU 250 is a part of the headset 240 in the near field. In other words, the headset 240 may be integral with the MU 250. Therefore, the headset 240 may sample RF near field energy directly from the MU 250 with the sense coil. Specifically, the exemplary system (e.g., the headset 240) may sense how much energy is emitted from the MU 250. If the net energy is not equal to zero, an error vector may be generated as feedback to the system. Accordingly, the system may minimize the field on the T-coil. This may allow for the feedback circuitry to selectively cancel the MU energy in order to maintain a net energy of zero. Furthermore, it should be noted that keeping the MU 250 in the near field, in a fixed orientation to the sense and induction coils, the field orientations may be much more predictable and repeatable.

Figure 3:
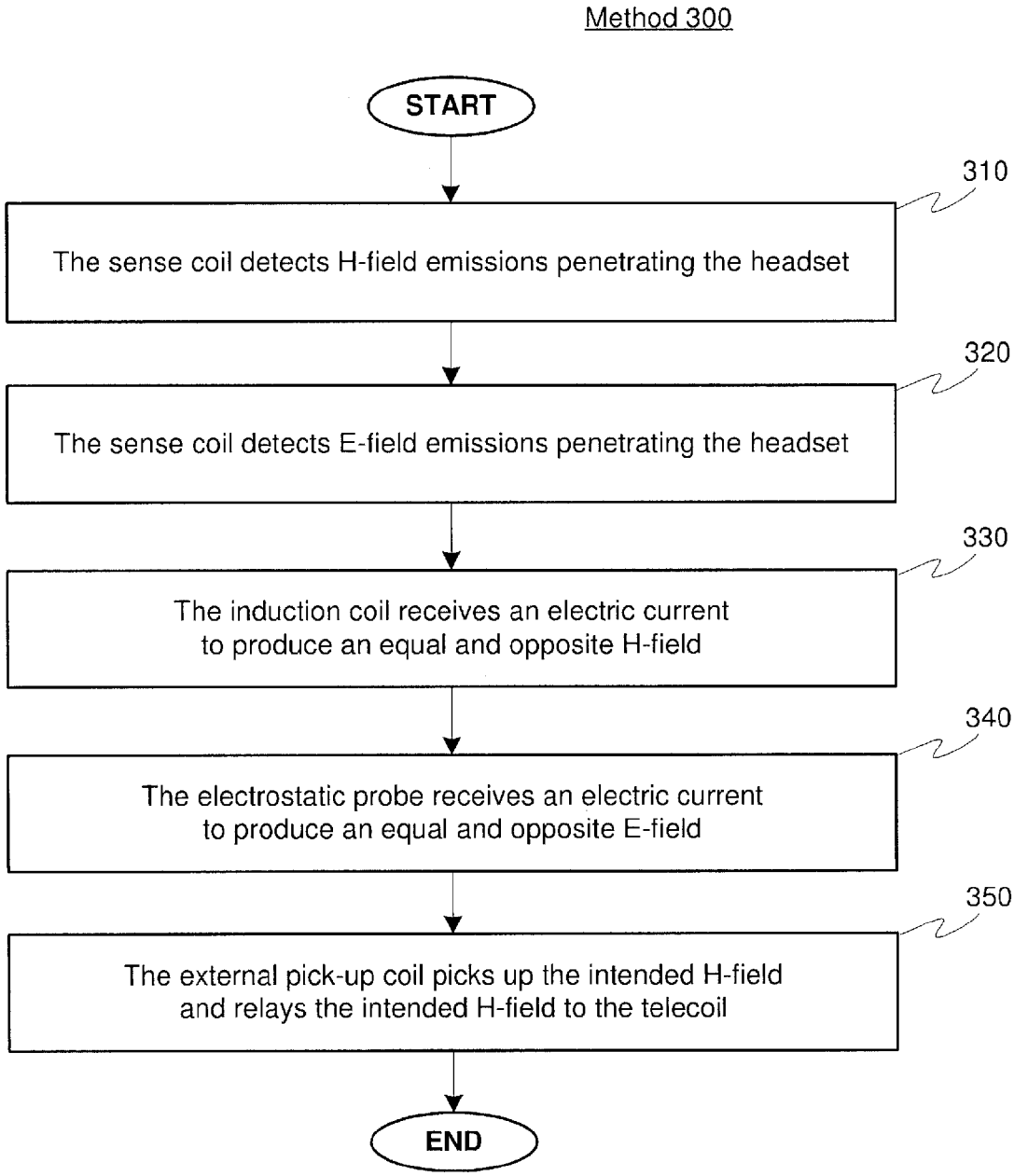
FIG. 3 shows an exemplary method for shielding magnetic field emissions and/or electric field emissions from a mobile unit according to the exemplary embodiments of the present invention.

FIG. 3 shows an exemplary method 300 for shielding magnetic field emissions and/or electric field emissions from a mobile unit according to the exemplary embodiments of the present invention. The exemplary method 300 will be described with reference to the exemplary embodiments of FIGS. 1 and 2. As described above, the headset 220 may shield the electromagnetic emissions 215 from the MU 210 in order to diminished or canceled out any interference with the telecoil 285. The exemplary MU 210 may be a device such as a mobile phone. Alternatively, the exemplary embodiments of the present invention may apply to other devices, such as fixed landlines, cordless phones, PDAs, laptop computers, etc.

In step 310, the sense element 150 may detect any H-field emissions penetrating both the inner and outer walls 130 and 140 of the headset 120. Specifically, the system 100 may generate a voltage across the sense element 150 in order to sense a magnitude, polarization and a polarity of the magnetic emissions received from the MU 210. As described above, the sense element 150 may quantify the transmission field strength of the penetrating magnetic field. The strength of the magnetic field may be used to determine the strength of an equal and opposite magnetic field in order to cancel the inductive field at the telecoil 180.

In step 320, the E-field sense element 150 may detect any E-field emissions penetrating both the inner and outer walls 130 and 140 of the headset 120. Similar to the detection of the H-field, the system 100 may generate a voltage across the E-field sense element 150 in order to sense a magnitude, polarization and a polarity of the electric emissions received from the MU 210. As such, the E-field sense element 150 may quantify the transmission field strength of the penetrating electric field, wherein the strength of the electric field may then be used to determine the strength of an equal and opposite electric field in order to cancel the E-field at the telecoil 180.

In step 330, the system 100 may apply a current to the induction coil 160 in order to produce an opposing H-field. Specifically, as described above, the opposing H-field may be emitted from the induction coil 160 in order to diminish or cancel out the penetrating magnetic field detected by the sense element 150. In other words, strength of the induction coil 160 may be dynamically regulated based on the strength of the magnetic field emitted from the MU 210. Due to the close proximity of the induction coil 160 to the telecoil 180, the current applied to the induction coil 160 may nullify both the sense element 150 and the telecoil 180.

In step 340, the system 100 may apply a voltage to electrostatic probes within the headset 120 in order to produce an opposing E-field. Specifically, as described above, the opposing E-field may be emitted from the induction coil 160 in order to diminish or cancel out the penetrating electric field detected by the E-field sense element 150. In other words, the electrostatic probes may serve as an E-field canceller, wherein the probes may be dynamically regulated based on the strength of the electric field emitted from the MU 210. Therefore, both the electric and the magnetic fields emitted from the MU 210 that penetrate the headset 120 may be canceled through the use of adjusting both the induction coil 160 and the electrostatic probes.

According to an additional embodiment of the presenting invention, in step 350, an external pick-up coil may be used to receive any intended H-field emissions from the ambient environment. Accordingly, these intended H-field emissions may be relayed through the headset 220 to the telecoil 285 by the induction coil. Thus, the unwanted H-field emissions are shielded and canceled from the telecoil 285, while the intended H-field emissions are received and processed by the telecoil 285.

FIGS. 4*a*-4*i* show exemplary element orientations for shielding of magnetic field emissions and/or electric field emissions from a mobile unit according to the exemplary embodiments of the present invention. The device for canceling the electromagnetic radiation may be the headset similar to headset 120 illustrated in FIG. 1, and may include both a bucking probe and a sense coil, or sense probe. The bucking probe within the headset may take the same configuration as the sense probe. In addition, the bucking probe may be positioned slightly farther away from the ear than the sense probe, similar to the induction coil 160 illustrated in FIG. 1.

Figure 4:
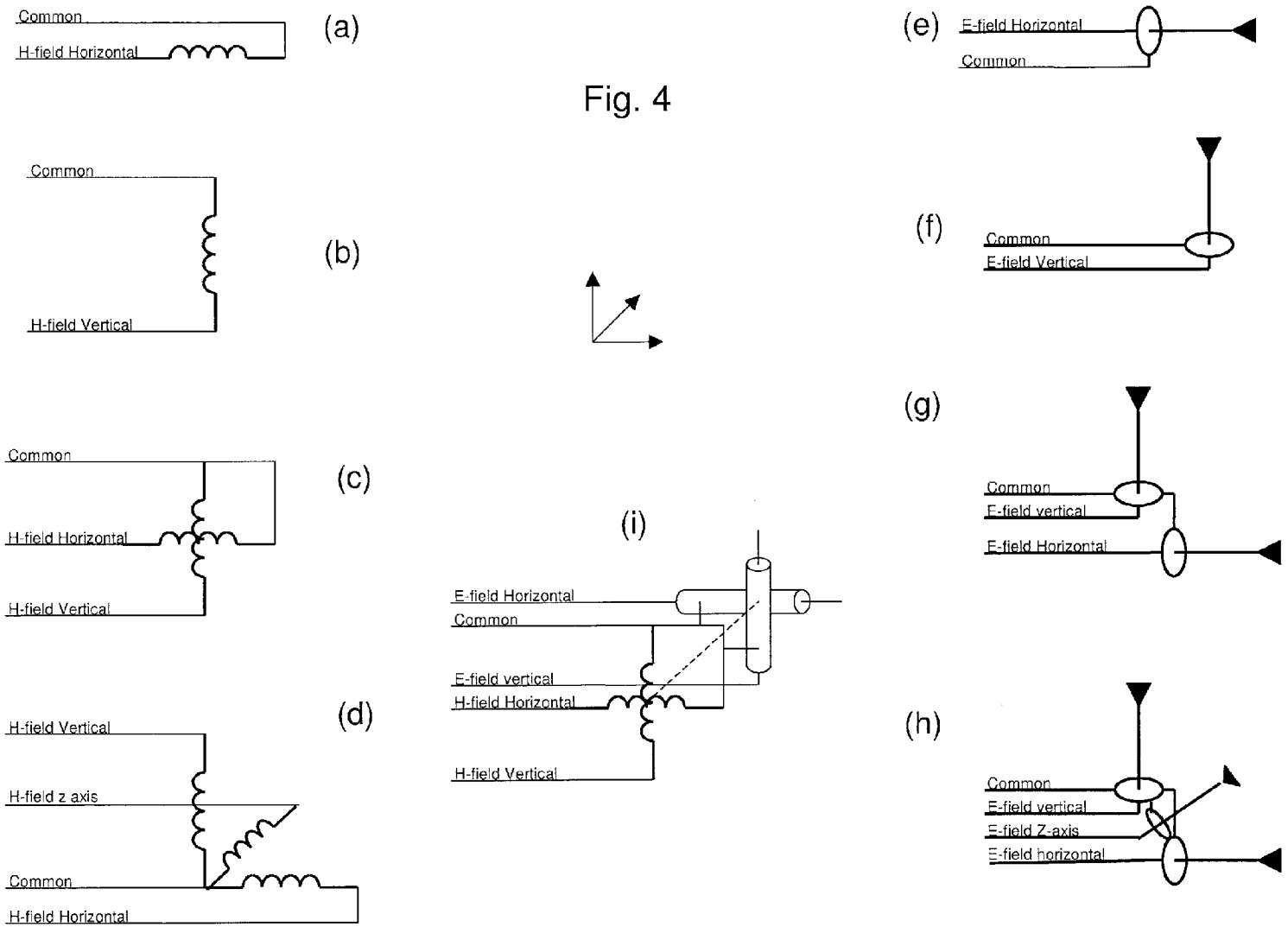
FIG. 4*a*-4*i* show exemplary element orientations for shielding of magnetic field emissions and/or electric field emissions from a mobile unit according to the exemplary embodiments of the present invention.

As described above, the different means of cancellation may include near-field cancellation, such as H-field and E-field cancellation, as well as audio cancellation. In any of the cancellation techniques, the sense probe position that is in close proximity to the hearing air device may receive a sample of incident radiation. According to the various embodiments of the present invention, the sense probe may be a singly polarized linear element, a dual orthogonal cross-polarized array, or a triple orthogonal cross-polarized array. It should also be noted, as illustrated in FIGS. 4*a*-4*i*, that the sense probe may be a single, a dual, or a triple cross-polarized array of H-field elements (FIGS. 4*a*-4*d*) and/or of E-field elements (FIGS. 4*e*-4*h*). FIG. 4*i* shows dual orthogonal cross-polarized arrays for both the H-field and E-field. Accordingly, different combinations of field emissions along either axis may be used to null different types and polarizations of electromagnetic radiation. Furthermore, these sense elements may be inductive and/or capacitive in any or all three of the X-, Y-, and Z-axis. Accordingly, six different components may be utilized within the bucking probe to negate, or nullify, the E and/or H-field along these three axes.

Each of the sensing elements may include a demodulator that samples a local field in both in-phase (I), and quadrature phase (P), or "out-phase." Specifically, the component of the local field that is "in phase" with the original carrier may be referred to as the in-phase (I) component, while the other component, which is always 90° "out of phase", may be referred to as the quadrature phase (P) component. These local fields sampled by sensing elements may be considered error signals.

Accordingly, the exemplary bucking probe may then use these error signals to control a vector modulator in order to create a cancellation signal from a sample of a transmitter. When the cancellation signal flows into the bucking probe, a field cancellation may occur if the phase and amplitude of the bucking signal is equal and opposite of the induced signal received at the sense probe. This cancellation may, in turn, cause the sense probe power to null. Furthermore, the cancellation may cause the local field of that type and polarization to null as well. In other words, the bucking probe may use a similar field to the sample from each axis within either field, wherein the similar field has the same orientation. Therefore, the bucking probe may null each of the error signals for each field along all three axes. Since the sense probe may be located in close proximity to the hearing aid device, the field in the vicinity of the hearing aid device will be greatly reduced.

If the distance from the sense probe to the hearing aid device and the respective polarization is known, these factors may be induced into the system to allow for pre-distortion. The pre-distortion may be utilized to remove the displacement error of the null at the hearing aid device. In other words, the relative phases for each element may be calculated and then offset through the bucking probe. For example, the bucking probe may include a vector multiplier to accurately reproduce the transmitted sample while allowing for both phase and amplitude adjustments.

According to the exemplary embodiments of the present invention, a common sensing probe and bucking probe may be achieved using the same probe for both applications. By summing a directional current into the sensing/bucking probe, a counter field may be generated. Furthermore, the demodulated signals may be nulled when the local fields are nulled. A common demodulator may be time shared between the sensing probe elements if the values of the demodulated signals are held for each respective element and continually applied to an error amplifier for each of the associated bucking probes.

It will be apparent to those skilled in the art that various modifications may be made in the present invention, without departing from the spirit or the scope of the invention. Thus, it is intended that the present invention cover modifications and variations of this invention provided they come within the scope of the appended claimed and their equivalents.

What is claimed is:

1. A device for reducing interference for a hearing aid device, comprising:

a housing including an inner wall and an outer wall, at least one of the inner and outer wall provides partial electromagnetic shielding;

a sense coil located within the inner wall of the housing in proximity to the hearing aid device, the sense coil operable for sensing a magnitude, polarization and a polarity of an inbound interfering magnetic field within the housing; and an induction coil located between the outer wall and the inner wall of the housing, the induction coil operable for generating an outbound magnetic field having the same polarization and an opposing polarity to the polarity of the inbound interfering magnetic field, wherein the outbound magnetic field is of a magnitude substantially equal to the magnitude of the inbound interfering magnetic field such that the induction coil substantially nullifies the interfering magnetic field within the hearing aid device.

2. The device of claim 1, wherein the sense coil is further configured to sense an inbound interfering electric field, and further comprising an electrostatic probe operable for generating an outbound electric field to nullify the inbound interfering electric field within the hearing aid device.

3. The device of claim 1, wherein the induction coil is configured with up to three orthogonally-oriented coils to cancel cancels at least one of a magnetic field component in each of up to three orthogonal directions.

4. The device of claim 1, wherein the induction coil is also operable as a pick-up coil external to the hearing aid and operable for picking up an intended magnetic field and relaying the intended magnetic field to a telecoil of the hearing aid device via the sense coil.

5. The device of claim 4, further comprising:

an external audio pick-up configured to convert audio signals to electric signals to drive the induction coil to relay the signals to the telecoil.

6. The device of claim 1, wherein the outbound magnetic field from the induction coil is also operable to nullify the interfering magnetic field within the sense coil.

7. The device of claim 1, wherein the magnetic sense coil can include a singly-polarized element.

8. The device of claim 1, wherein the magnetic sense coil can include a dual orthogonal cross-polarized array.

9. The device of claim 1, wherein the magnetic sense coil can include a triple orthogonal cross-polarized array.

10. The device of claim 1, further comprising an electric sense probe wherein the sense probe can include dual orthogonal elements.

11. The device of claim 1, further comprising an electric sense probe wherein the sense probe can include triple orthogonal elements.

12. The device of claim 1, wherein pre-distortion is applied for the outbound magnetic field at the induction coil to correct displacement error of the nullification at the hearing aid device.

13. A method for reducing interference for a hearing aid device, comprising:

sensing, by a sensing coil, a polarization, magnitude and a polarity of an inbound interfering magnetic field, the sensing coil located within a housing of a device and disposed within a wall providing partial electromagnetic shielding, the sensing coil located in proximity to the hearing aid device; and applying a current to an induction coil disposed outside of the wall to generate an outbound electromagnetic field having the same polarization and an opposing polarity to the polarity of the inbound interfering magnetic field, the induction coil located within the housing of the device and disposed outside a wall providing partial electromagnetic shielding, wherein the outbound magnetic field is of a magnitude substantially equal to the magnitude of the inbound interfering magnetic field such that the induction coil substantially nullifies the interfering magnetic field within the hearing aid device.

* * * * *

UNITED STATES PATENT AND TRADEMARK OFFICE

CERTIFICATE OF CORRECTION

PATENT NO. : 8,218,801 B2
APPLICATION NO. : 12/130361
DATED : July 10, 2012
INVENTOR(S) : Duron et al.

It is certified that error appears in the above-identified patent and that said Letters Patent is hereby corrected as shown below:

In Column 9, Line 41, in Claim 3, delete “cancel cancels” and insert -- cancel --, therefor.

Signed and Sealed this
Twenty-second Day of January, 2013

David J. Kappos

David J. Kappos
*Director of the United States Patent and Trademark Office*